United States Patent [19]

Manion et al.

[11] 3,958,602

[45] May 25, 1976

[54] FLUERIC LAMINAR DIGITAL AMPLIFIER

[75] Inventors: Francis M. Manion, Rockville; Tadeusz M. Drzewiecki, Silver Spring, both of Md.

[73] Assignee: The United States of America as represented by the Secretary of the Army, Washington, D.C.

[22] Filed: Mar. 12, 1975

[21] Appl. No.: 557,705

[52] U.S. Cl. ..... 137/836; 137/840

[51] Int. Cl.[2] ..... F15C 1/10; F15C 1/18

[58] Field of Search ..... 137/834, 836, 837, 838, 137/840, 842

[56] References Cited

UNITED STATES PATENTS

| | | | |
|---|---|---|---|
| 3,552,414 | 1/1971 | Sutton | 137/837 X |
| 3,589,381 | 6/1971 | Yamamoto | 137/837 |
| 3,667,489 | 6/1972 | Blaiklock | 137/837 |
| 3,734,116 | 5/1973 | Trask | 137/836 |
| 3,785,390 | 1/1974 | Taylor | 137/840 |
| 3,786,839 | 1/1974 | Manion et al | 137/837 |
| 3,811,476 | 5/1974 | Drzewiecki | 137/842 |

*Primary Examiner*—William R. Cline
*Attorney, Agent, or Firm*—Nathan Edelberg; Robert P. Gibson; Saul Elbaum

[57] ABSTRACT

Described herein is a flueric laminar bi-stable amplifier. The device comprises essentially a flueric amplifier having a supply nozzle, a pair of outlet nozzles, a pair of control nozzles, vent means located along the axial path of fluid flow and means for providing a supply of pressure to the vent means so as to maintain the vent pressure above ambient pressure. Means are also provided for grounding the control ports and for providing back pressure to the control ports. Essentially, the device is a flueric laminar flip-flop that does not use the Coanda effect, but rather it relies upon the instability of jet position due to vent pressurization. If vent flow is allowed to enter the control region in excess of that demanded by entrainment and the control port is vented to ambient, then any small perturbation will cause more flow to enter one side and less on the other, thereby increasing the pressure differential and causing the jet to deflect more until it reaches a stable position on one side or the other.

4 Claims, 3 Drawing Figures

FLUERIC LAMINAR DIGITAL AMPLIFIER

RIGHTS OF THE GOVERNMENT

This invention may be used by or for the United States Government without the payment to the inventors of any royalties thereon.

BACKGROUND OF THE INVENTION

Flueric logic devices have, since their introduction in 1959, been limited to three distinct categories. The coanda effect or wall attachment devices, the turbulence amplifiers and the impact modulators. Each of these devices operated at some stage in the turbulent flow regime, and all but the turbulence amplifiers require considerable continuous operating power in the order of 0.5 watts. The necessity of a continuous supply of fluid makes fluerics at best an unattractive choice when considering large, complex or mobile circuitry. Because of this, much effort has been expended in lowering the power consumption of flueric logic devices. One such attempt resulted in a laminar NOR gate that operated at several milliwatts of power but with a fairly low fanout of about 3. It became apparent that low power was synonymous with laminar flow. Several further studies of laminar wall attachment showed that one could obtain a Coanda type flow even in the laminar mode; however, no practical flueric devices were forthcoming.

At the same time that the search was proceeding for low power logic devices, much progress was being made in the development of laminar proportional amplifiers. It has been shown that a laminar proportional amplifier can exhibit dynamic ranges and signal to noise ratios of several orders of magnitude greater than comparable turbulent devices, along with improved gain characteristics. As these amplifiers were being developed, it became of interest to increase the input resistance so that it would essentially operate in a completely differential control pressure mode at zero control flow (e.g., infinite power gain).

A primary object of this invention is, therefore, to provide a flueric laminar amplifier that does not use the Coanda effect.

Another object of this invention is to provide a bi-stable flueric digital amplifier which operates efficiently at low power.

Yet an additional object of the invention is to provide a bi-stable flueric laminar amplifier having a high gain and a high signal to noise ratio.

These and other objects, aspects and advantages of the invention will become more readily apparent with respect to the detailed specification and appended claims.

SUMMARY OF THE INVENTION

Briefly, in accordance with this invention, a flueric laminar bi-stable device is provided which comprises a flueric amplifier device having a supply nozzle, a pair of outlet nozzles, a pair of control nozzles, vent means located along the fluid path between the supply nozzle and the outlet nozzles, vent means located along the fluid path between the supply nozzle and the outlet nozzles, and means for providing a supply of pressure to the vents so as to maintain the vent pressure above ambient pressure. Additional means are provided for both grounding the control ports and also providing a source of back pressure to the control ports. The design is such that if vent flow is allowed to enter the control region in excess of that demanded by entrainment, and the control port is vented to ambient, then any small perturbation will cause more flow to enter one side and less on the other, thereby increasing the pressure differential and causing the jet to deflect more until it reaches a stable position on one side or the other. The ultimate result is that the flueric laminar bi-stable device is designed so as not to rely upon the Coanda effect but rather upon the instability of jet position due to vent pressurization. The availability of such a precision bi-stable device makes it possible to consider accurate timers and counters, pulse duration modulators and analog-to-digital converters.

DESCRIPTION OF THE PREFERRED EMBODIMENT

Figure 1:
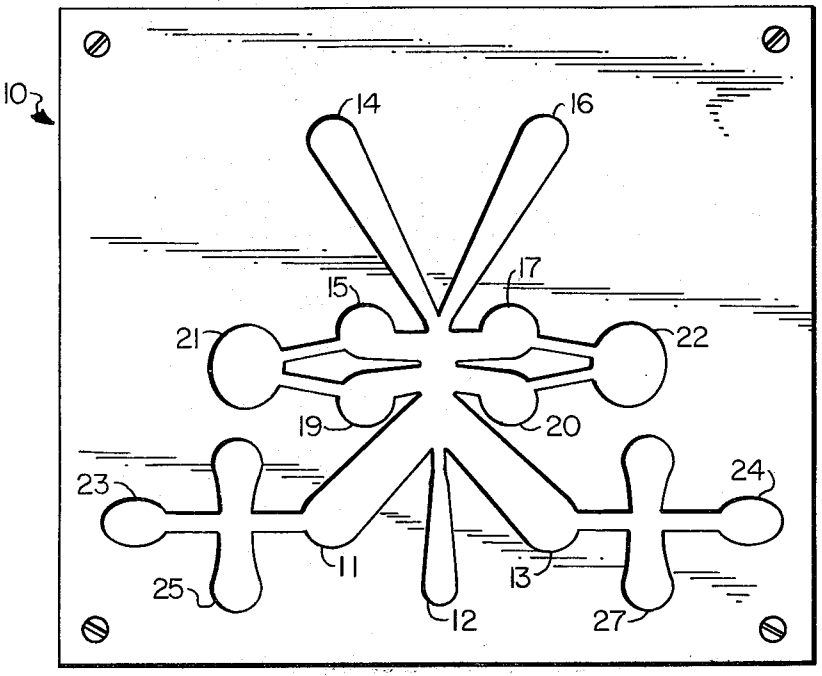
FIG. 1 is a plan view of one embodiment of the invention.

Referring now to FIG. 1, the flueric amplifier 10 is shown having a power input nozzle 12 for directing fluid flow towards either of output channels 14 or 16. Control channels 11 and 13 are provided to direct the flow of fluid to either of output channels 14 or 16, respectively, as desired. A plurality of vents, 15, 17, 19 and 20, are provided axially along the path of fluid flow in the manner that is generally well known an practiced in this art.

Vents 15 and 19 are tied together by a source of pressurizing fluid 21. Similarly, vents 17 and 20 are tied together to a source of pressurizing fluid 22. The reason and purpose for these sources of pressurizing fluid will become apparent with subsequent detailed explanations.

Figure 2:
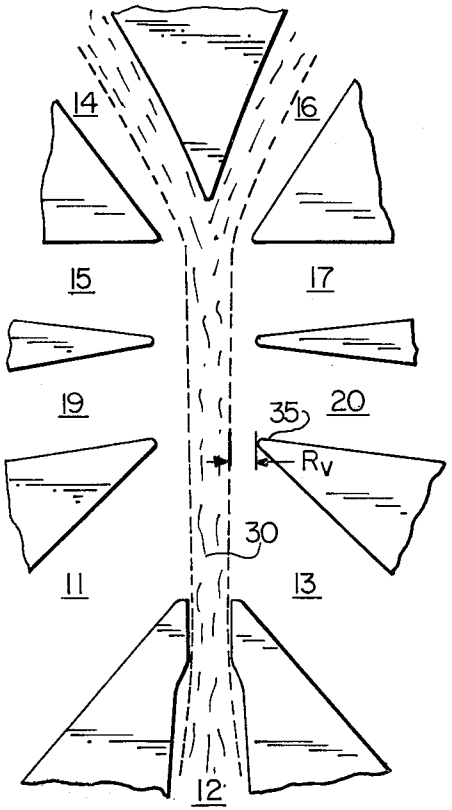
FIG. 2 illustrates the fluid flow path within the embodiment of FIG. 1.

The flow field can be readily visualized under normal operating conditions as shown in FIG. 2. As the jet emanates from the supply nozzle 12, it splits evenly on the splitter and is directed to outlet channels 14 and 16. When a sufficient pressure differential is applied at the controls 11 and 13, flow from the control is exhausted to the upstream vent 20 between the space defined by the jet edge 30 and the downstream edge of the control channel 35. This space, marked $R_v$ in FIG. 2 may be considered to be much like an orifice, except that the opening increases as the jet is being deflected.

Figure 3:
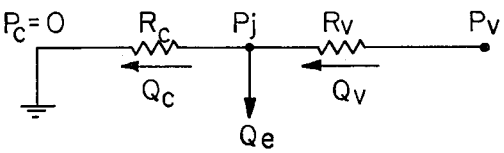
FIG. 3 is a schematic electrical analog representation of the fluid flow dynamics of FIG. 1.

Consider now the situation in which the vents are maintained at a pressure higher than the pressure at the jet edge. In this case, flow passes from the vent region to the jet edge, thereby reducing the flow required through the control passage 13. Referring to FIG. 3, this control passage is schematically indicated as $R_c$. In this way, the input resistance is increasing.

Consider now the case where the control ports are maintained at ambient pressure and the jet is centered as shown in FIG. 2. In such a case, the flow entrained by the portion of the jet in the control region ($Q_c$ in FIG. 3) must be supplied from both the first vent and the control port. This means that the pressure at the jet edge, $P_j$, is lower than ambient when the vent is at ambient pressure.

Now if the vent pressure $P_v$ is increased to the point where the flow entrained by the jet is equal to the flow from the vent $Q_v$ then the flow through the control port $Q_c$ will be zero. The jet is, therefore, in equilibrium because there are no excess flows and entrainment is fully satisfied.

If the vent pressure is now further increased so that there is flow entering from the vent in excess of that demanded by entrainment, then a metastable situation occurs. The excess flow over and above entrainment now exits through the control port. Hence, the pressure at the jet edge is above ambient (recalling that the control port is at ambient pressure).

Should the jet move slightly due to any perturbation to one side or the other, such movement would increase the vent width on one side and decrease it on the other. Therefore, more flow would enter through the wider space and less through the narrower space. Since the control resistance $R_c$ is constant, it follows that for more control flow out which is equal to the excess of vent flow by the laws of continuity, the jet edge pressure would necessarily have to increase on the side with more flow. Conversely, it would necessarily have to decrease on the side with less flow. This is then an applied pressure differential to the jet so that the jet deflects more and more until it is in a position completely blocking off vent flow on one side. In such a situation, the amplifier would be in a stable state and a bi-stable device will have been achieved.

In order to achieve the above described operation, the conventional laminar proportional amplifier had to be modified in several respects. The first, referring to FIG. 1, was to provide the supply of pressure to the vents. This is accomplished by collecting the vents in a junction and supplying the vents by an independent pressure source 21 and 22 as shown. Alternatively, the same result could be accomplished by providing a bleed flow through a resistor from the supply port of the amplifier to the collected vent junction.

The next required modifications were to provide grounded control ports and a means for pressurizing these control ports despite their grounded condition. The grounding of the control ports and of providing pressurization to the control ports are accomplished by providing grounding ports 25 and 27 in conjunction with new jet sources 23 and 24, respectively. It is important to bear in mind that in the present situation the control fluid is blowing out of the device. If this outflow is formed into a jet and exhausted across a vent such as vents 25 and 27, the grounding function is performed. That pressurization is achieved by providing the new jet sources 23 and 24 so as to axially impinge on the control out-flow jet. The result will be a back pressure of the out-flow jet which will be increased as the amount of fluid flow in new jet sources 23 and 24 is increased.

It should be apparent from the foregoing that a bistable flueric laminar device has been provided which does not rely upon the traditional Coanda effect but rather upon the instability of jet position due to vent pressurization. This development makes possible a precision flip-flop for use in accurate timers and counters, pulse duration modulators and analog to digital converters.

It should be understood that the inventors do not desire to be limited to the exact details of construction shown and described, for obvious modifications can be made by persons skilled in the art.

We claim as our invention:

1. A flueric laminar bistable amplifier comprising: a supply nozzle means for providing a laminar fluid jet stream; a pair of outlet channel means for receiving the laminar fluid jet from said supply nozzle means; an interaction region disposed between said supply nozzle means and said outlet channel means in which region the deflection of said laminar fluid jet stream into a respective one of said outlet channel means is effected; a pair of control channels communicating with said interaction region and disposed ajacent said supply nozzle means on opposite sides thereof; a pair of vent channels communicating with said interaction region and disposed down stream of said control channels to opposite sides of the laminar fluid jet from said supply nozzle means; supply means connected to said vent channels for supplying fluid pressure to said vent channels to cause a fluid flow therefrom in excess of that required for entrainment by the fluid jet stream; means coupled to each control channel means for venting same to ambient and providing an exhaust path for the excess fluid flow from said vent channels over and above the flow required for entrainment; and means for providing back pressure within said control channel means to impinge upon and control the out flow of said excess fluid through said exhaust path.

2. The device of claim 1 wherein said means for providing a supply of pressure to said vents comprises a junction coupling the vents and an independent fluid pressure source supplied to said junction.

3. The device of claim 2 wherein said junction is supplied by fluid derived from the supply nozzle through a resistor.

4. The device of claim 1 wherein said means for providing back pressure to said control channels comprises a back pressure jet located to axially impinge on the outflowing excess fluid.

* * * * *